US007653533B2

(12) United States Patent
Pang et al.

(10) Patent No.: US 7,653,533 B2
(45) Date of Patent: Jan. 26, 2010

(54) REMOVING TIME DELAYS IN SIGNAL PATHS

(75) Inventors: Hee Suk Pang, Seoul (KR); Dong Soo Kim, Seoul (KR); Jae Hyun Lim, Seoul (KR); Hyen O. Oh, Goyang-si (KR); Yang Won Jung, Seoul (KR)

(73) Assignee: LG Electronics Inc., Seoul (KR)

( * ) Notice: Subject to any disclaimer, the term of this patent is extended or adjusted under 35 U.S.C. 154(b) by 551 days.

(21) Appl. No.: 11/540,920

(22) Filed: Sep. 29, 2006

(65) Prior Publication Data

US 2007/0094011 A1 Apr. 26, 2007

Related U.S. Application Data

(60) Provisional application No. 60/792,329, filed on Apr. 17, 2006, provisional application No. 60/786,740, filed on Mar. 29, 2006, provisional application No. 60/757,005, filed on Jan. 9, 2006, provisional application No. 60/729,225, filed on Oct. 24, 2005.

(51) Int. Cl.
*G10L 21/00* (2006.01)

(52) U.S. Cl. ..... 704/201; 704/220; 704/502

(58) Field of Classification Search ..... 704/501–504, 704/201, 227, 228, 203, 205, 229, 230, 500, 704/220

See application file for complete search history.

(56) References Cited

U.S. PATENT DOCUMENTS

| | | | | |
|---|---|---|---|---|
| 4,621,862 | A | 11/1986 | Kramer | |
| 4,661,862 | A | 4/1987 | Thompson | |
| 4,725,885 | A | 2/1988 | Gonzales et al. | |
| 4,907,081 | A | 3/1990 | Okumura et al. | |
| 5,481,643 | A | 1/1996 | Kate et al. | |
| 5,515,296 | A | 5/1996 | Agarwal | |
| 5,530,750 | A | 6/1996 | Akagiri | |
| 5,563,661 | A | 10/1996 | Takahashi et al. | |
| 5,579,430 | A | 11/1996 | Grill et al. | |
| 5,606,618 | A | 2/1997 | Lokhoff et al. | |
| 5,621,856 | A | 4/1997 | Akagiri | |
| 5,640,159 | A | 6/1997 | Fulran et al. | |
| 5,682,461 | A | 10/1997 | Silzle et al. | |
| 5,687,157 | A | 11/1997 | Imai et al. | |
| 5,890,125 | A * | 3/1999 | Davis et al. | 704/501 |
| 5,912,636 | A | 6/1999 | Gormish et al. | |

(Continued)

FOREIGN PATENT DOCUMENTS

| | | |
|---|---|---|
| EP | 372601 | 6/1990 |

(Continued)

OTHER PUBLICATIONS

Notice of Allowance issued in corresponding Korean Application Serial No. 2008-7007453, dated Feb. 27, 2009 (no English translation available).

(Continued)

*Primary Examiner*—Huyen X. Vo
(74) *Attorney, Agent, or Firm*—Fish & Richardson P.C.

(57) ABSTRACT

The disclosed embodiments include systems, methods, apparatuses, and computer-readable mediums for compensating one or more signals and/or one or more parameters for time delays in one or more signal processing paths.

15 Claims, 10 Drawing Sheets

U.S. PATENT DOCUMENTS

| | | | | |
|---|---|---|---|---|
| 5,945,930 | A | 8/1999 | Kajiwara | |
| 5,974,380 | A | 10/1999 | Smyth et al. | |
| 6,021,386 | A | 2/2000 | Davis et al. | |
| 6,125,398 | A | 9/2000 | Mirashrafi et al. | |
| 6,134,518 | A | 10/2000 | Cohen et al. | |
| 6,208,276 | B1 | 3/2001 | Snyder | |
| 6,295,319 | B1 | 9/2001 | Sueyoshi et al. | |
| 6,309,424 | B1 | 10/2001 | Fallon | |
| 6,339,760 | B1 | 1/2002 | Koda et al. | |
| 6,384,759 | B2 | 5/2002 | Snyder | |
| 6,421,467 | B1 | 7/2002 | Mitra | |
| 6,453,120 | B1 | 9/2002 | Takahashi et al. | |
| 6,556,685 | B1 | 4/2003 | Urry et al. | |
| 6,611,212 | B1 | 8/2003 | Craven et al. | |
| 6,631,352 | B1 | 10/2003 | Fujita et al. | |
| 6,636,830 | B1 | 10/2003 | Princen et al. | |
| 7,519,538 | B2 * | 4/2009 | Villemoes et al. | 704/501 |
| 2003/0009325 | A1 | 1/2003 | Kirchherr et al. | |
| 2003/0016876 | A1 | 1/2003 | Chai et al. | |
| 2003/0138157 | A1 | 7/2003 | Schwartz | |
| 2003/0195742 | A1 | 10/2003 | Tsushima | |
| 2003/0236583 | A1 | 12/2003 | Baumgarte et al. | |
| 2004/0049379 | A1 | 3/2004 | Thumpudi et al. | |
| 2004/0138895 | A1 | 7/2004 | Lokhoff et al. | |
| 2004/0186735 | A1 | 9/2004 | Ferris et al. | |
| 2004/0199276 | A1 | 10/2004 | Poon | |
| 2005/0058304 | A1 | 3/2005 | Baumgarte et al. | |
| 2005/0074127 | A1 | 4/2005 | Herre et al. | |
| 2005/0074135 | A1 | 4/2005 | Kushibe | |
| 2005/0091051 | A1 | 4/2005 | Moriya et al. | |
| 2005/0114126 | A1 | 5/2005 | Geiger et al. | |
| 2005/0137729 | A1 | 6/2005 | Sakurai et al. | |
| 2005/0174269 | A1 | 8/2005 | Sherigar et al. | |
| 2005/0216262 | A1 | 9/2005 | Fejzo | |
| 2007/0038439 | A1 * | 2/2007 | Schuijers et al. | 704/212 |

FOREIGN PATENT DOCUMENTS

| | | |
|---|---|---|
| EP | 599825 | 6/1994 |
| EP | 827312 | 3/1998 |
| EP | 0 867 867 | 9/1998 |
| EP | 948141 | 10/1999 |
| EP | 957639 | 11/1999 |
| EP | 1376538 | 1/2004 |
| EP | 1396843 | 3/2004 |
| GB | 2238445 | 5/1991 |
| GB | 2340351 | 2/2002 |
| JP | 60-096079 | 5/1985 |
| JP | 62-094090 | 4/1987 |
| JP | 09-275544 | 10/1997 |
| JP | 11-205153 | 7/1999 |
| JP | 2001-188578 | 7/2001 |
| JP | 2001-53617 | 9/2002 |
| JP | 2002-328699 | 11/2002 |
| JP | 2003-005797 | 1/2003 |
| JP | 2003-233395 | 8/2003 |
| JP | 2004-170610 | 6/2004 |
| KR | 1997-0014387 | 3/1997 |
| KR | 2001-0001991 | 5/2001 |
| KR | 2003-0043620 | 6/2003 |
| KR | 2003-0043622 | 6/2003 |
| RU | 2 158 970 | 10/2000 |
| RU | 2 221 329 | 1/2004 |
| RU | 2005/103637 | 7/2005 |
| WO | WO 95/27337 | 10/1995 |
| WO | 97/40630 | 10/1997 |
| WO | 99/52326 | 10/1999 |
| WO | 00/02357 | 1/2000 |
| WO | 00/60746 | 10/2000 |
| WO | WO 00/79520 | 12/2000 |
| WO | WO 03/046889 | 6/2003 |
| WO | 03/090028 | 10/2003 |
| WO | 03/090206 | 10/2003 |
| WO | 03/090207 | 10/2003 |
| WO | 2004/008805 | 1/2004 |
| WO | 2004/008806 | 1/2004 |
| WO | 2004/028142 | 4/2004 |
| WO | 2004/080125 | 9/2004 |
| WO | 2004/093495 | 10/2004 |
| WO | WO 2005/043511 | 5/2005 |
| WO | WO 2005043511 A1 * | 5/2005 |
| WO | 2005/059899 | 6/2005 |
| WO | WO 2006/048226 | 5/2006 |
| WO | WO 2006/108464 | 10/2006 |

OTHER PUBLICATIONS

Bessette B, et al.: Universal Speech/Audio Coding Using Hybrid ACELP/TCX Techniques, 2005, 4 pages.

Boltze Th. et al.; "Audio services and applications." In: Digital Audio Broadcasting. Edited by Hoeg, W. and Lauferback, Th. ISBN 0-470-85013-2. John Wiley & Sons Ltd., 2003. pp. 75-83.

Breebaart, J., AES Convention Paper 'MPEG Spatial audio coding/MPEG surround: Overview and Current Status', 119th Convention, Oct. 7-10, 2005, New York, New York, 17 pages.

Chou, J. et al.: Audio Data Hiding with Application to Surround Sound, 2003, 4 pages.

Faller C., et al.: Binaural Cue Coding- Part II: Schemes and Applications, 2003, 12 pages, IEEE Transactions on Speech and Audio Processing, vol. 11, No. 6.

Faller C.: Parametric Coding of Spatial Audio. Doctoral thesis No. 3062, 2004, 6 pages.

Faller, C: "Coding of Spatial Audio Compatible with Different Playback Formats", Audio Engineering Society Convention Paper, 2004, 12 pages, San Francisco, CA.

Hamdy K.N., et al.: Low Bit Rate High Quality Audio Coding with Combined Harmonic and Wavelet Representations, 1996, 4 pages.

Heping, D.,: Wideband Audio Over Narrowband Low-Resolution Media, 2004, 4 pages.

Herre, J. et al.: MP3 Surround: Efficient and Compatible Coding of Multi-channel Audio, 2004, 14 pages.

Herre, J. et al: The Reference Model Architecture for MPEG Spatial Audio Coding, 2005, 13 pages, Audio Engineering Society Convention Paper.

Hosoi S., et al.: Audio Coding Using the Best Level Wavelet Packet Transform and Auditory Masking, 1998, 4 pages.

International Search Report corresponding to International Application No. PCT/KR2006/002018 dated Oct. 16, 2006, 1 page.

International Search Report corresponding to International Application No. PCT/KR2006/002019 dated Oct. 16, 2006, 1 page.

International Search Report corresponding to International Application No. PCT/KR2006/002020 dated Oct. 16, 2006, 2 pages.

International Search Report corresponding to International Application No. PCT/KR2006/002021 dated Oct. 16, 2006, 1 page.

International Search Report corresponding to International Application No. PCT/KR2006/002575, dated Jan. 12, 2007, 2 pages.

International Search Report corresponding to International Application No. PCT/KR2006/002578, dated Jan. 12, 2007, 2 pages.

International Search Report corresponding to International Application No. PCT/KR2006/002579, dated Nov. 24, 2006, 1 page.

International Search Report corresponding to International Application No. PCT/KR2006/002581, dated Nov. 24, 2006, 2 pages.

International Search Report corresponding to International Application No. PCT/KR2006/002583, dated Nov. 24, 2006, 2 pages.

International Search Report corresponding to International Application No. PCT/KR2006/003420, dated Jan. 18, 2007, 2 pages.

International Search Report corresponding to International Application No. PCT/KR2006/003424, dated Jan. 31, 2007, 2 pages.

International Search Report corresponding to International Application No. PCT/KR2006/003426, dated Jan. 18, 2007, 2 pages.

International Search Report corresponding to International Application No. PCT/KR2006/003435, dated Dec. 13, 2006, 1 page.

International Search Report corresponding to International Application No. PCT/KR2006/003975, dated Mar. 13, 2007, 2 pages.

International Search Report corresponding to International Application No. PCT/KR2006/004014, dated Jan. 24, 2007, 1 page.
International Search Report corresponding to International Application No. PCT/KR2006/004017, dated Jan. 24, 2007, 1 page.
International Search Report corresponding to International Application No. PCT/KR2006/004020, dated Jan. 24, 2007, 1 page.
International Search Report corresponding to International Application No. PCT/KR2006/004024, dated Jan. 29, 2007, 1 page.
International Search Report corresponding to International Application No. PCT/KR2006/004025, dated Jan. 29, 2007, 1 page.
International Search Report corresponding to International Application No. PCT/KR2006/004027, dated Jan. 29, 2007, 1 page.
International Search Report corresponding to International Application No. PCT/KR2006/004032, dated Jan. 24, 2007, 1 page.
International Search Report in corresponding International Application No. PCT/KR2006/004023, dated Jan. 23, 2007, 1 page.
ISO/IEC 13818-2, Generic Coding of Moving Pictures and Associated Audio, Nov. 1993, Seoul, Korea.
ISO/IEC 14496-3 Information Technology—Coding of Audio-Visual Objects—Part 3: Audio, Second Edition (ISO/IEC), 2001.
Jibra A., et al.: Multi-layer Scalable LPC Audio Format; ISACS 2000, 4 pages, IEEE International Symposium on Circuits and Systems.
Jin C, et al.: Individualization in Spatial-Audio Coding, 2003, 4 pages, IEEE Workshop on Applications of Signal Processing to Audio and Acoustics.
Kostantinides K: An introduction to Super Audio CD and DVD-Audio, 2003, 12 pages, IEEE Signal Processing Magazine.
Liebchem, T.; Reznik, Y.A.: MPEG-4: an Emerging Standard for Lossless Audio Coding, 2004, 10 pages, Proceedings of the Data Compression Conference.
Ming, L.: A novel random access approach for MPEG-1 multicast applications, 2001, 5 pages.
Moon, Han-gil, et al.: A Multi-Channel Audio Compression Method with Virtual Source Location Information for MPEG-4 SAC, IEEE 2005, 7 pages.
Moriya T., et al.,: A Design of Lossless Compression for High-Quality Audio Signals, 2004, 4 pages.
Notice of Allowance dated Aug. 25, 2008 by the Korean Patent Office for counterpart Korean Appln. Nos. 2008-7005851, 7005852; and 7005858.
Notice of Allowance dated Dec. 26, 2008 by the Korean Patent Office for counterpart Korean Appln. Nos. 2008-7005836, 7005838, 7005839, and 7005840.
Notice of Allowance dated Jan. 13, 2009 by the Korean Patent Office for a counterpart Korean Appln. No. 2008-7005992.
Office Action dated Jul. 21, 2008 issued by the Taiwan Patent Office, 16 pages.
Oh, E., et al.: Proposed changes in MPEG-4 BSAC multi channel audio coding, 2004, 7 pages, International Organisation for Standardisation.
Pang, H., et al., .“Extended Pilot-Based Codling for Lossless Bit Rate Reduction of MPEG Surround”, ETRI Journal, vol. 29, No. 1, Feb. 2007.
Puri, A., et al.: MPEG-4: An object-based multimedia coding standard supporting mobile applications, 1998, 28 pages, Baltzer Science Publishers BV.
Said, A.: On the Reduction of Entropy Coding Complexity via Symbol Grouping: I—Redundancy Analysis and Optimal Alphabet Partition, 2004, 42 pages, Hewlett-Packard Company.
Schroeder E F et al: DER MPEG-2STANDARD: Generische Codierung fur Bewegtbilder und zugehorige Audio-Information, 1994, 5 pages.
Schuijers, E. et al: Low Complexity Parametric Stereo Coding, 2004, 6 pages, Audio Engineering Society Convention Paper 6073.
Stoll, G.: MPEG Audio Layer II: A Generic Coding Standard for Two and Multichannel Sound for DVB, DAB and Computer Multimedia, 1995, 9 pages, International Broadcasting Convention, XP006528918.
Supplementary European Search Report corresponding to Application No. EP06747465, dated Oct. 10, 2008, 8 pages.
Supplementary European Search Report corresponding to Application No. EP06747467, dated Oct. 10, 2008, 8 pages.
Supplementary European Search Report corresponding to Application No. EP06757755, dated Aug. 1, 2008, 1 page.
Supplementary European Search Report corresponding to Application No. EP06843795, dated Aug. 7, 2008, 1 page.
Ten Kate W. R. Th., et al.: A New Surround-Stereo-Surround Coding Technique, 1992, 8 pages, J. Audio Engineering Society, XP002498277.
Voros P.: High-quality Sound Coding within 2x64 kbit/s Using Instantaneous Dynamic Bit-Allocation, 1988, 4 pages.
Webb J., et al.: Video and Audio Coding for Mobile Applications, 2002, 8 pages, The Application of Programmable DSPs in Mobile Communications.
“Text of second working draft for MPEG Surround”, ISO/IEC JTC 1/SC 29/WG 11, No. N7387, No. N7387, Jul. 29. 2005, 140 pages.
Oh, H-O et al., “Proposed core experiment on pilot-based coding of spatial parameters for MPEG surround”, ISO/IEC JTC 1/SC 29/WG 11, No. M12549, Oct. 13, 2005, 18 pages XP030041219.
Quackenbush, S. R. et al., “Noiseless coding of quantized spectral components in MPEG-2 Advanced Audio Coding”, Application of Signal Processing to Audio and Acoustics, 1997. 1997 IEEE ASSP Workshop on New Paltz, NY, US held on Oct. 19-22, 1997, New York, NY, US, IEEE, US, (Oct. 19, 1997), 4 pages.
Pang, H., “Clipping Prevention Scheme for MPEG Surround”, ETRI Journal, vol. 30, No. 4, Aug. 2008, pp. 606-608.
Herre, J et al., “Overview of MPEP-4 Audio and its Applications in Mobile Communications”, IEEE 2000, pp. 604-613.
Non-final Office Action in U.S. Appl. No. 12/089,383, mailed Jun. 25, 2009, 16 pages.
European Search Report in Application No. 067577510.0-2225, mailed Jun. 8, 2009, 5 pages.
European Search Report in Application No. 06799058.0-2225, mailed Jun. 16, 2009, 6 pages.
Russian Notice of Allowance in Application No. 2008112226/09(013215), mailed Jun. 5, 2009, 15 pages.
Russian Notice of Allowance in Application No. 2008103314/09(003616), mailed Apr. 27, 2009, 11 pages.

* cited by examiner

REMOVING TIME DELAYS IN SIGNAL PATHS

RELATED APPLICATIONS

This application claims the benefit of priority from the following U.S. and Korean patent applications:

- U.S. Provisional Patent Application No. 60/729,225, filed Oct. 24, 2005;
- U.S. Provisional Patent Application No. 60/757,005, filed Jan. 9, 2006;
- U.S. Provisional Patent Application No. 60/786,740, filed Mar. 29, 2006;
- U.S. Provisional Patent Application No. 60/792,329, filed Apr. 17, 2006;
- Korean Patent Application No. 10-2006-0078218, filed Aug. 18, 2006;
- Korean Patent Application No. 10-2006-0078221, filed Aug. 18, 2006;
- Korean Patent Application No. 10-2006-0078222, filed Aug. 18, 2006;
- Korean Patent Application No. 10-2006-0078223, filed Aug. 18, 2006;
- Korean Patent Application No. 10-2006-0078225, filed Aug. 18, 2006; and
- Korean Patent Application No. 10-2006-0078219, filed Aug. 18, 2006.

Each of these patent applications is incorporated by reference herein in its entirety.

TECHNICAL FIELD

The disclosed embodiments relate generally to signal processing.

BACKGROUND

Multi-channel audio coding (commonly referred to as spatial audio coding) captures a spatial image of a multi-channel audio signal into a compact set of spatial parameters that can be used to synthesize a high quality multi-channel representation from a transmitted downmix signal.

In a multi-channel audio system, where several coding schemes are supported, a downmix signal can become time delayed relative to other downmix signals and/or corresponding spatial parameters due to signal processing (e.g., time-to-frequency domain conversions).

SUMMARY

The disclosed embodiments include systems, methods, apparatuses, and computer-readable mediums for compensating one or more signals and/or one or more parameters for time delays in one or more signal processing paths.

In some embodiments, a method of processing an audio signal includes: receiving an audio signal including a downmix signal and spatial information; converting the downmix signal from a first domain to a second domain; and combining the converted downmix signal and the spatial information, wherein at least one of the combined downmix signal and the combined spatial information is delayed by amount of time that includes an elapsed time of the converting.

In some embodiments, a system for generating a plural-channel audio signal includes a downmix decoder configured for processing an encoded downmix signal. A plural-channel decoder is operatively coupled to the downmix decoder and configured for generating a plural-channel audio signal. A domain converter is included in the plural-channel decoder and configured for converting the downmix signal from a first domain to a second domain. A delay processor included in the plural-channel decoder and configured for compensating the downmix signal for time delay resulting from converting the downmix signal.

In some embodiments, a system for generating a plural-channel audio signal includes a domain converter configured for converting a downmix signal from a first domain to a second domain. A delay processor is operatively coupled to the domain converter and configured for compensating the converted downmix signal for time delay resulting from the conversion. A plural-channel audio processor is operatively coupled to the delay processor and configured for generating a plural-channel audio signal from the compensated downmix signal and spatial information.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION

Figure 1:
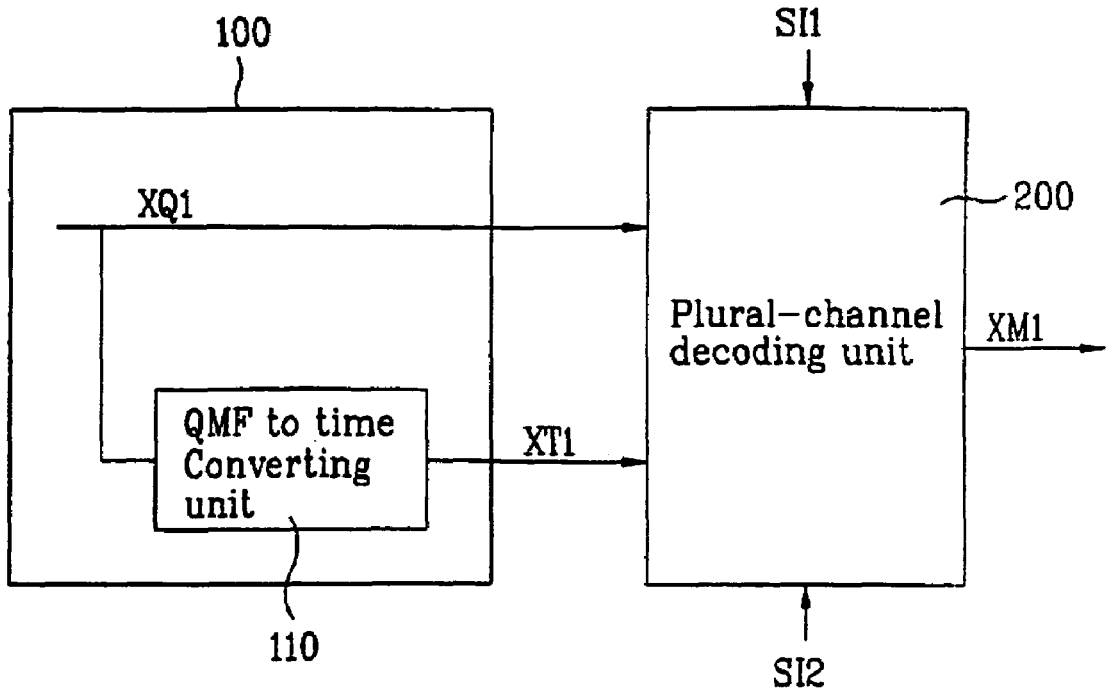
FIGS. 1 to 3 are block diagrams of apparatuses for decoding an audio signal according to embodiments of the present invention, respectively.

Reference will now be made in detail to the preferred embodiments of the present invention, examples of which are illustrated in the accompanying drawings. Wherever possible, the same reference numbers will be used throughout the drawings to refer to the same or like parts.

Since signal processing of an audio signal is possible in several domains, and more particularly in a time domain, the audio signal needs to be appropriately processed by considering time alignment.

Therefore, a domain of the audio signal can be converted in the audio signal processing. The converting of the domain of the audio signal maybe include a T/F(Time/Frequency) domain conversion and a complexity domain conversion. The T/F domain conversion includes at least one of a time domain signal to a frequency domain signal conversion and a frequency domain signal to time domain signal conversion. The complexity domain conversion means a domain conversion according to complexity of an operation of the audio signal processing. Also, the complexity domain conversion includes a signal in a real frequency domain to a signal in a complex frequency domain, a signal in a complex frequency domain to a signal in a real frequency domain, etc. If an audio signal is processed without considering time alignment, audio quality may be degraded. A delay processing can be performed for the alignment. The delay processing can include at least one of an encoding delay and a decoding delay. The encoding delay means that a signal is delayed by a delay accounted for in the encoding of the signal. The decoding delay means a real time delay introduced during decoding of the signal.

Prior to explaining the present invention, terminologies used in the specification of the present invention are defined as follows.

'Downmix input domain' means a domain of a downmix signal receivable in a plural-channel decoding unit that generates a plural-channel audio signal.

'Residual input domain' means a domain of a residual signal receivable in the plural-channel decoding unit.

'Time-series data' means data that needs time synchronization with a plural-channel audio signal or time alignment. Some examples of 'time series data' includes data for moving pictures, still images, text, etc.

'Leading' means a process for advancing a signal by a specific time.

'Lagging' means a process for delaying a signal by a specific time.

'Spatial information' means information for synthesizing plural-channel audio signals. Spatial information can be spatial parameters, including but not limited to: CLD (channel level difference) indicating an energy difference between two channels, ICC (inter-channel coherences) indicating correlation between two channels), CPC (channel prediction coefficients) that is a prediction coefficient used in generating three channels from two channels, etc.

The audio signal decoding described herein is one example of signal processing that can benefit from the present invention. The present invention can also be applied to other types of signal processing (e.g., video signal processing). The embodiments described herein can be modified to include any number of signals, which can be represented in any kind of domain, including but not limited to: time, Quadrature Mirror Filter (QMF), Modified Discreet Cosine Transform (MDCT), complexity, etc.

A method of processing an audio signal according to one embodiment of the present invention includes generating a plural-channel audio signal by combining a downmix signal and spatial information. There can exist a plurality of domains for representing the downmix signal (e.g., time domain, QMF, MDCT). Since conversions between domains can introduce time delay in the signal path of a downmix signal, a step of compensating for a time synchronization difference between a downmix signal and spatial information corresponding to the downmix signal is needed. The compensating for a time synchronization difference can include delaying at least one of the downmix signal and the spatial information. Several embodiments for compensating a time synchronization difference between two signals and/or between signals and parameters will now be described with reference to the accompanying figures.

Any reference to an "apparatus" herein should not be construed to limit the described embodiment to hardware. The embodiments described herein can be implemented in hardware, software, firmware, or any combination thereof.

The embodiments described herein can be implemented as instructions on a computer-readable medium, which, when executed by a processor (e.g., computer processor), cause the processor to perform operations that provide the various aspects of the present invention described herein. The term "computer-readable medium" refers to any medium that participates in providing instructions to a processor for execution, including without limitation, non-volatile media (e.g., optical or magnetic disks), volatile media (e.g., memory) and transmission media. Transmission media includes, without limitation, coaxial cables, copper wire and fiber optics. Transmission media can also take the form of acoustic, light or radio frequency waves.

FIG. 1 is a diagram of an apparatus for decoding an audio signal according to one embodiment of the present invention.

Referring to FIG. 1, an apparatus for decoding an audio signal according to one embodiment of the present invention includes a downmix decoding unit 100 and a plural-channel decoding unit 200.

The downmix decoding unit 100 includes a domain converting unit 110. In the example shown, the downmix decoding unit 100 transmits a downmix signal XQ1 processed in a QMF domain to the plural-channel decoding unit 200 without further processing. The downmix decoding unit 100 also transmits a time domain downmix signal XT1 to the plural-channel decoding unit 200, which is generated by converting the downmix signal XQ1 from the QMF domain to the time domain using the converting unit 110. Techniques for converting an audio signal from a QMF domain to a time domain are well-known and have been incorporated in publicly available audio signal processing standards (e.g., MPEG).

The plural-channel decoding unit 200 generates a plural-channel audio signal XM1 using the downmix signal XT1 or XQ1, and spatial information SI1 or SI2.

Figure 2:
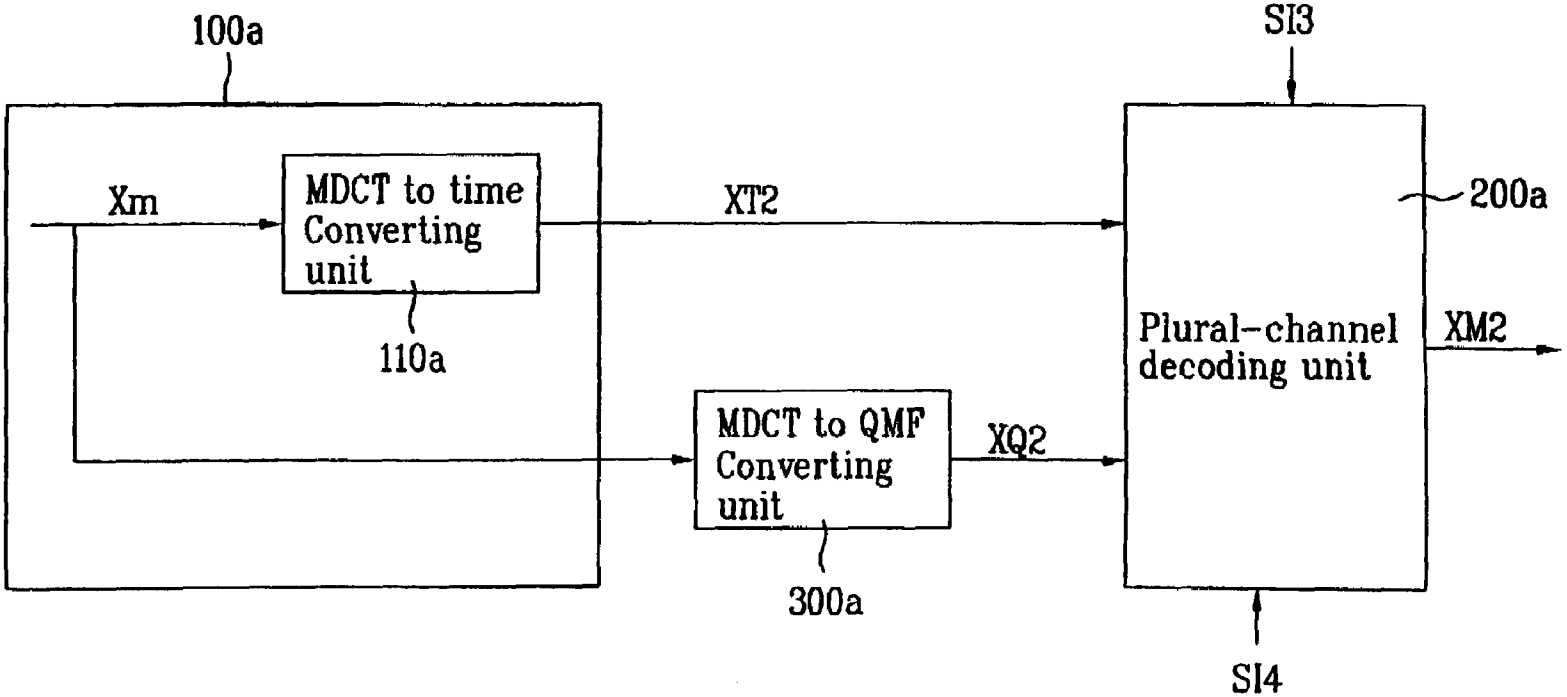

FIG. 2 is a diagram of an apparatus for decoding an audio signal according to another embodiment of the present invention.

Referring to FIG. 2, the apparatus for decoding an audio signal according to another embodiment of the present invention includes a downmix decoding unit 100*a*, a plural-channel decoding unit 200*a* and a domain converting unit 300*a*.

The downmix decoding unit 100*a* includes a domain converting unit 110*a*. In the example shown, the downmix decoding unit 100*a* outputs a downmix signal Xm processed in a MDCT domain. The downmix decoding unit 100*a* also outputs a downmix signal XT2 in a time domain, which is generated by converting Xm from the MDCT domain to the time domain using the converting unit 110*a*.

The downmix signal XT2 in a time domain is transmitted to the plural-channel decoding unit 200*a*. The downmix signal Xm in the MDCT domain passes through the domain converting unit 300*a*, where it is converted to a downmix signal XQ2 in a QMF domain. The converted downmix signal XQ2 is then transmitted to the plural-channel decoding unit 200*a*.

The plural-channel decoding unit 200*a* generates a plural-channel audio signal XM2 using the transmitted downmix signal XT2 or XQ2 and spatial information SI3 or SI4.

Figure 3:
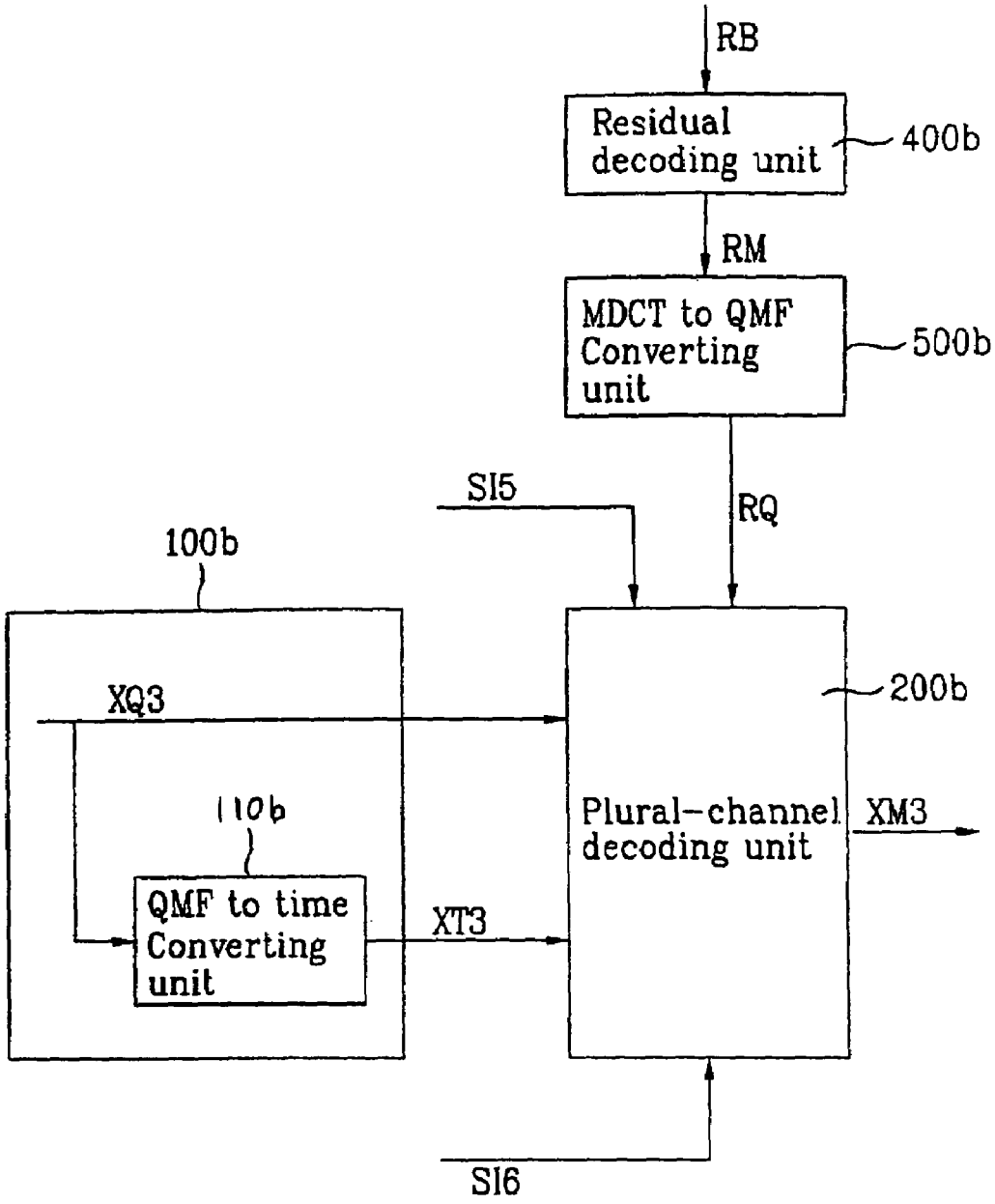

FIG. 3 is a diagram of an apparatus for decoding an audio signal according to another embodiment of the present invention.

Referring to FIG. 3, the apparatus for decoding an audio signal according to another embodiment of the present invention includes a downmix decoding unit 100*b*, a plural-channel decoding unit 200*b*, a residual decoding unit 400*b* and a domain converting unit 500*b*.

The downmix decoding unit 100*b* includes a domain converting unit 110*b*. The downmix decoding unit 100*b* transmits a downmix signal XQ3 processed in a QMF domain to the plural-channel decoding unit 200*b* without further processing. The downmix decoding unit 100*b* also transmits a downmix signal XT3 to the plural-channel decoding unit 200*b*, which is generated by converting the downmix signal XQ3 from a QMF domain to a time domain using the converting unit 110*b*.

In some embodiments, an encoded residual signal RB is inputted into the residual decoding unit 400*b* and then processed. In this case, the processed residual signal RM is a signal in an MDCT domain. A residual signal can be, for example, a prediction error signal commonly used in audio coding applications (e.g., MPEG).

Subsequently, the residual signal RM in the MDCT domain is converted to a residual signal RQ in a QMF domain by the domain converting unit 500*b*, and then transmitted to the plural-channel decoding unit 200*b*.

If the domain of the residual signal processed and outputted in the residual decoding unit 400*b* is the residual input domain, the processed residual signal can be transmitted to the plural-channel decoding unit 200*b* without undergoing a domain converting process.

FIG. 3 shows that in some embodiments the domain converting unit 500*b* converts the residual signal RM in the MDCT domain to the residual signal RQ in the QMF domain. In particular, the domain converting unit 500*b* is configured to convert the residual signal RM outputted from the residual decoding unit 400*b* to the residual signal RQ in the QMF domain.

As mentioned in the foregoing description, there can exist a plurality of downmix signal domains that can cause a time synchronization difference between a downmix signal and spatial information, which may need to be compensated. Various embodiments for compensating time synchronization differences are described below.

An audio signal process according to one embodiment of the present invention generates a plural-channel audio signal by decoding an encoded audio signal including a downmix signal and spatial information.

In the course of decoding, the downmix signal and the spatial information undergo different processes, which can cause different time delays.

In the course of encoding, the downmix signal and the spatial information can be encoded to be time synchronized.

In such a case, the downmix signal and the spatial information can be time synchronized by considering the domain in which the downmix signal processed in the downmix decoding unit 100, 100*a* or 100*b* is transmitted to the plural-channel decoding unit 200, 200*a* or 200*b*.

In some embodiments, a downmix coding identifier can be included in the encoded audio signal for identifying the domain in which the time synchronization between the downmix signal and the spatial information is matched. In such a case, the downmix coding identifier can indicate a decoding scheme of a downmix signal.

For instance, if a downmix coding identifier identifies an Advanced Audio Coding(AAC) decoding scheme, the encoded audio signal can be decoded by an AAC decoder.

In some embodiments, the downmix coding identifier can also be used to determine a domain for matching the time synchronization between the downmix signal and the spatial information.

In a method of processing an audio signal according to one embodiment of the present invention, a downmix signal can be processed in a domain different from a time-synchronization matched domain and then transmitted to the plural-channel decoding unit 200, 200*a* or 200*b*. In this case, the decoding unit 200, 200*a* or 200*b* compensates for the time synchronization between the downmix signal and the spatial information to generate a plural-channel audio signal.

A method of compensating for a time synchronization difference between a downmix signal and spatial information is explained with reference to FIG. 1 and FIG. 4 as follows.

Figure 4:
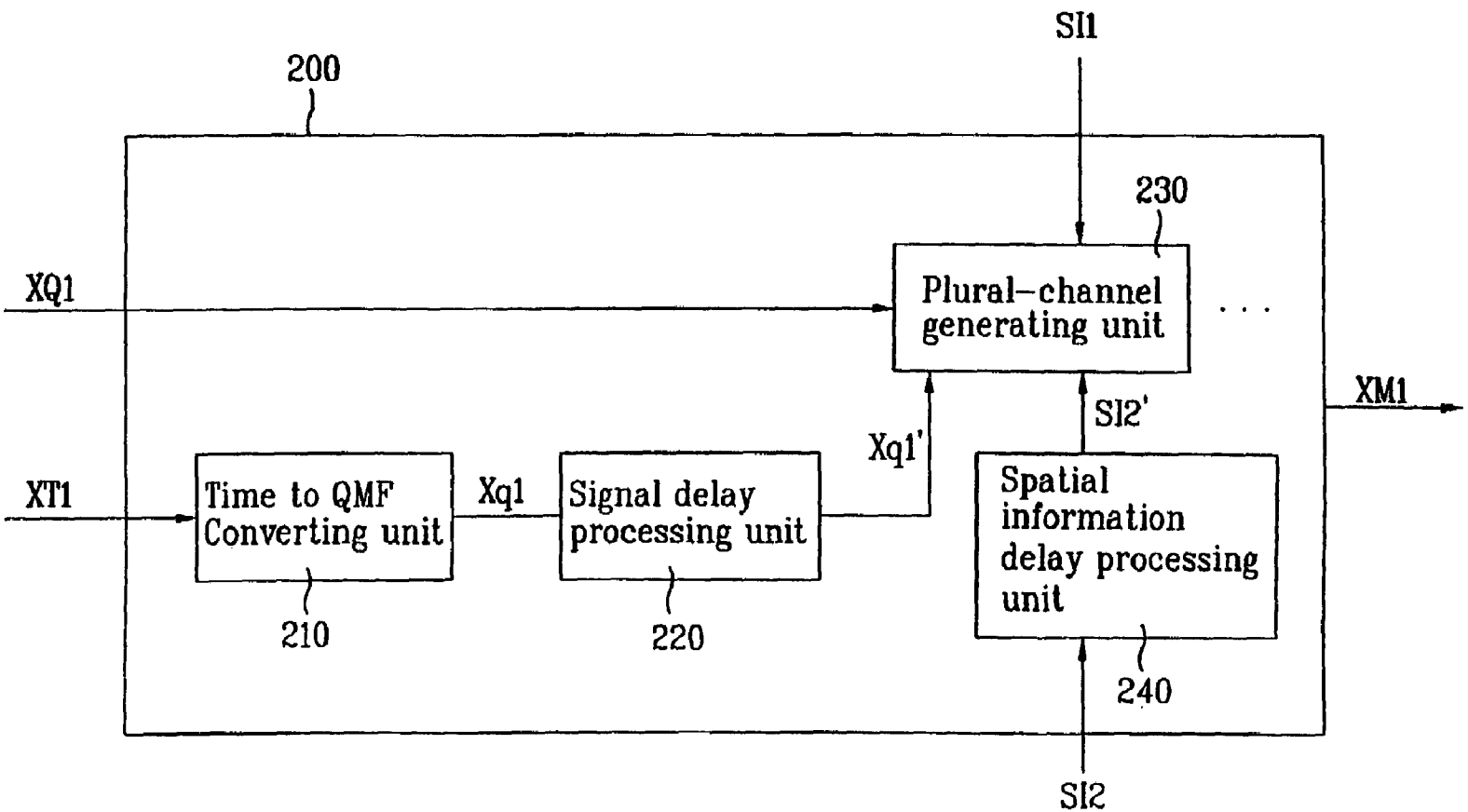
FIG. 4 is a block diagram of a plural-channel decoding unit shown in FIG. 1 to explain a signal processing method.

FIG. 4 is a block diagram of the plural-channel decoding unit 200 shown in FIG. 1.

Referring to FIG. 1 and FIG. 4, in a method of processing an audio signal according to one embodiment of the present invention, the downmix signal processed in the downmix decoding unit 100 (FIG. 1) can be transmitted to the plural-channel decoding unit 200 in one of two kinds of domains. In the present embodiment, it is assumed that a downmix signal and spatial information are matched together with time synchronization in a QMF domain. Other domains are possible.

In the example shown in FIG. 4, a downmix signal XQ1 processed in the QMF domain is transmitted to the plural-channel decoding unit 200 for signal processing.

The transmitted downmix signal XQ1 is combined with spatial information SI1 in a plural-channel generating unit 230 to generate the plural-channel audio signal XM1.

In this case, the spatial information SI1 is combined with the downmix signal XQ1 after being delayed by a time corresponding to time synchronization in encoding. The delay can be an encoding delay. Since the spatial information SI1 and the downmix signal XQ1 are matched with time synchronization in encoding, a plural-channel audio signal can be generated without a special synchronization matching process. That is, in this case, the spatial information ST1 is not delayed by a decoding delay.

In addition to XQ1, the downmix signal XT1 processed in the time domain is transmitted to the plural-channel decoding unit 200 for signal processing. As shown in FIG. 1, the downmix signal XQ1 in a QMF domain is converted to a downmix signal XT1 in a time domain by the domain converting unit 110, and the downmix signal XT1 in the time domain is transmitted to the plural-channel decoding unit 200.

Referring again to FIG. 4, the transmitted downmix signal XT1 is converted to a downmix signal Xq1 in the QMF domain by the domain converting unit 210.

In transmitting the downmix signal XT1 in the time domain to the plural-channel decoding unit 200, at least one of the downmix signal Xq1 and spatial information SI2 can be transmitted to the plural-channel generating unit 230 after completion of time delay compensation.

The plural-channel generating unit 230 can generate a plural-channel audio signal XM1 by combining a transmitted downmix signal Xql' and spatial information SI2'.

The time delay compensation should be performed on at least one of the downmix signal Xq1 and the spatial information SI2, since the time synchronization between the spatial information and the downmix signal is matched in the QMF domain in encoding. The domain-converted downmix signal Xq1 can be inputted to the plural-channel generating unit 230 after being compensated for the mismatched time synchronization difference in a signal delay processing unit 220.

A method of compensating for the time synchronization difference is to lead the downmix signal Xq1 by the time synchronization difference. In this case, the time synchronization difference can be a total of a delay time generated from the domain converting unit 110 and a delay time of the domain converting unit 210.

It is also possible to compensate for the time synchronization difference by compensating for the time delay of the spatial information SI2. For this case, the spatial information SI2 is lagged by the time synchronization difference in a spatial information delay processing unit 240 and then transmitted to the plural-channel generating unit 230.

A delay value of substantially delayed spatial information corresponds to a total of a mismatched time synchronization difference and a delay time of which time synchronization has been matched. That is, the delayed spatial information is delayed by the encoding delay and the decoding delay. This total also corresponds to a total of the time synchronization difference between the downmix signal and the spatial information generated in the downmix decoding unit 100 (FIG. 1) and the time synchronization difference generated in the plural-channel decoding unit 200.

The delay value of the substantially delayed spatial information SI2 can be determined by considering the performance and delay of a filter (e.g., a QMF, hybrid filter bank).

For instance, a spatial information delay value, which considers performance and delay of a filter, can be 961 time samples. In case of analyzing the delay value of the spatial information, the time synchronization difference generated in the downmix decoding unit 100 is 257 time samples and the time synchronization difference generated in the plural-channel decoding unit 200 is 704 time samples. Although the delay value is represented by a time sample unit, it can be represented by a timeslot unit as well.

Figure 5:
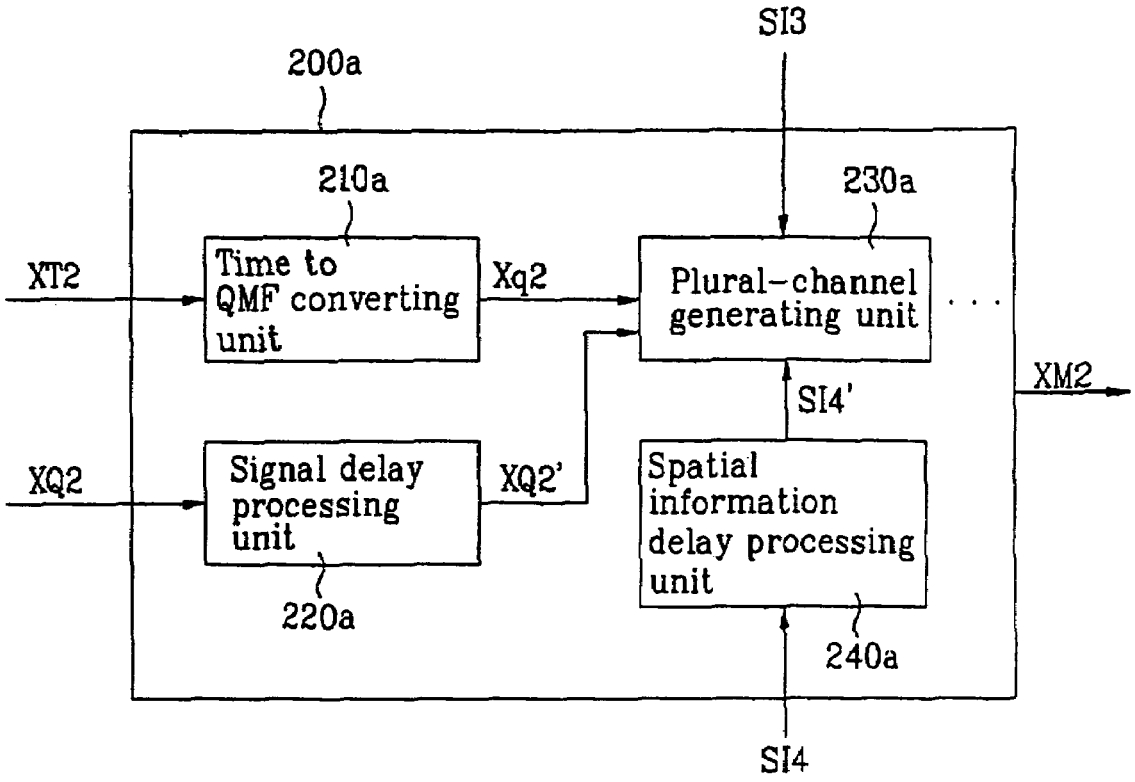
FIG. 5 is a block diagram of a plural-channel decoding unit shown in FIG. 2 to explain a signal processing method.

FIG. 5 is a block diagram of the plural-channel decoding unit 200*a* shown in FIG. 2.

Referring to FIG. 2 and FIG. 5, in a method of processing an audio signal according to one embodiment of the present invention, the downmix signal processed in the downmix decoding unit 100*a* can be transmitted to the plural-channel decoding unit 200*a* in one of two kinds of domains. In the present embodiment, it is assumed that a downmix signal and spatial information are matched together with time synchronization in a QMF domain. Other domains are possible. An audio signal, of which downmix signal and spatial information are matched on a domain different from a time domain, can be processed.

In FIG. 2, the downmix signal XT2 processed in a time domain is transmitted to the plural-channel decoding unit 200*a* for signal processing.

A downmix signal Xm in an MDCT domain is converted to a downmix signal XT2 in a time domain by the domain converting unit 110*a*.

The converted downmix signal XT2 is then transmitted to the plural-channel decoding unit 200*a*.

The transmitted downmix signal XT2 is converted to a downmix signal Xq2 in a QMF domain by the domain converting unit 210*a* and is then transmitted to a plural-channel generating unit 230*a*.

The transmitted downmix signal Xq2 is combined with spatial information S13 in the plural-channel generating unit 230*a* to generate the plural-channel audio signal XM2.

In this case, the spatial information S13 is combined with the downmix signal Xq2 after delaying an amount of time corresponding to time synchronization in encoding. The delay can be an encoding delay. Since the spatial information SI3 and the downmix signal Xq2 are matched with time synchronization in encoding, a plural-channel audio signal can be generated without a special synchronization matching process. That is, in this case, the spatial information SI3 is not delayed by a decoding delay.

In some embodiments, the downmix signal XQ2 processed in a QMF domain is transmitted to the plural-channel decoding unit 200*a* for signal processing.

The downmix signal Xm processed in an MDCT domain is outputted from a downmix decoding unit 100*a*. The outputted downmix signal Xm is converted to a downmix signal XQ2 in a QMF domain by the domain converting unit 300*a*. The converted downmix signal XQ2 is then transmitted to the plural-channel decoding unit 200*a*.

When the downmix signal XQ2 in the QMF domain is transmitted to the plural-channel decoding unit 200*a*, at least one of the downmix signal XQ2 or spatial information SI4 can be transmitted to the plural-channel generating unit 230*a* after completion of time delay compensation.

The plural-channel generating unit 230*a* can generate the plural-channel audio signal XM2 by combining a transmitted downmix signal XQ2' and spatial information SI4' together.

The reason why the time delay compensation should be performed on at least one of the downmix signal XQ2 and the spatial information SI4 is because time synchronization between the spatial information and the downmix signal is matched in the time domain in encoding. The domain-converted downmix signal XQ2 can be inputted to the plural-channel generating unit 230*a* after having been compensated for the mismatched time synchronization difference in a signal delay processing unit 220*a*.

A method of compensating for the time synchronization difference is to lag the downmix signal XQ2 by the time synchronization difference. In this case, the time synchronization difference can be a difference between a delay time generated from the domain converting unit 300*a* and a total of a delay time generated from the domain converting unit 110*a* and a delay time generated from the domain converting unit 210*a*.

It is also possible to compensate for the time synchronization difference by compensating for the time delay of the spatial information SI4. For such a case, the spatial information SI4 is led by the time synchronization difference in a spatial information delay processing unit 240*a* and then transmitted to the plural-channel generating unit 230*a*.

A delay value of substantially delayed spatial information corresponds to a total of a mismatched time synchronization difference and a delay time of which time synchronization has been matched. That is, the delayed spatial information SI4' is delayed by the encoding delay and the decoding delay.

A method of processing an audio signal according to one embodiment of the present invention includes encoding an audio signal of which time synchronization between a downmix signal and spatial information is matched by assuming a specific decoding scheme and decoding the encoded audio signal.

There are several examples of a decoding schemes that are based on quality (e.g., high quality AAC) or based on power (e.g., Low Complexity AAC). The high quality decoding scheme outputs a plural-channel audio signal having audio quality that is more refined than that of the lower power decoding scheme. The lower power decoding scheme has relatively lower power consumption due to its configuration, which is less complicated than that of the high quality decoding scheme.

In the following description, the high quality and low power decoding schemes are used as examples in explaining the present invention. Other decoding schemes are equally applicable to embodiments of the present invention.

Figure 6:
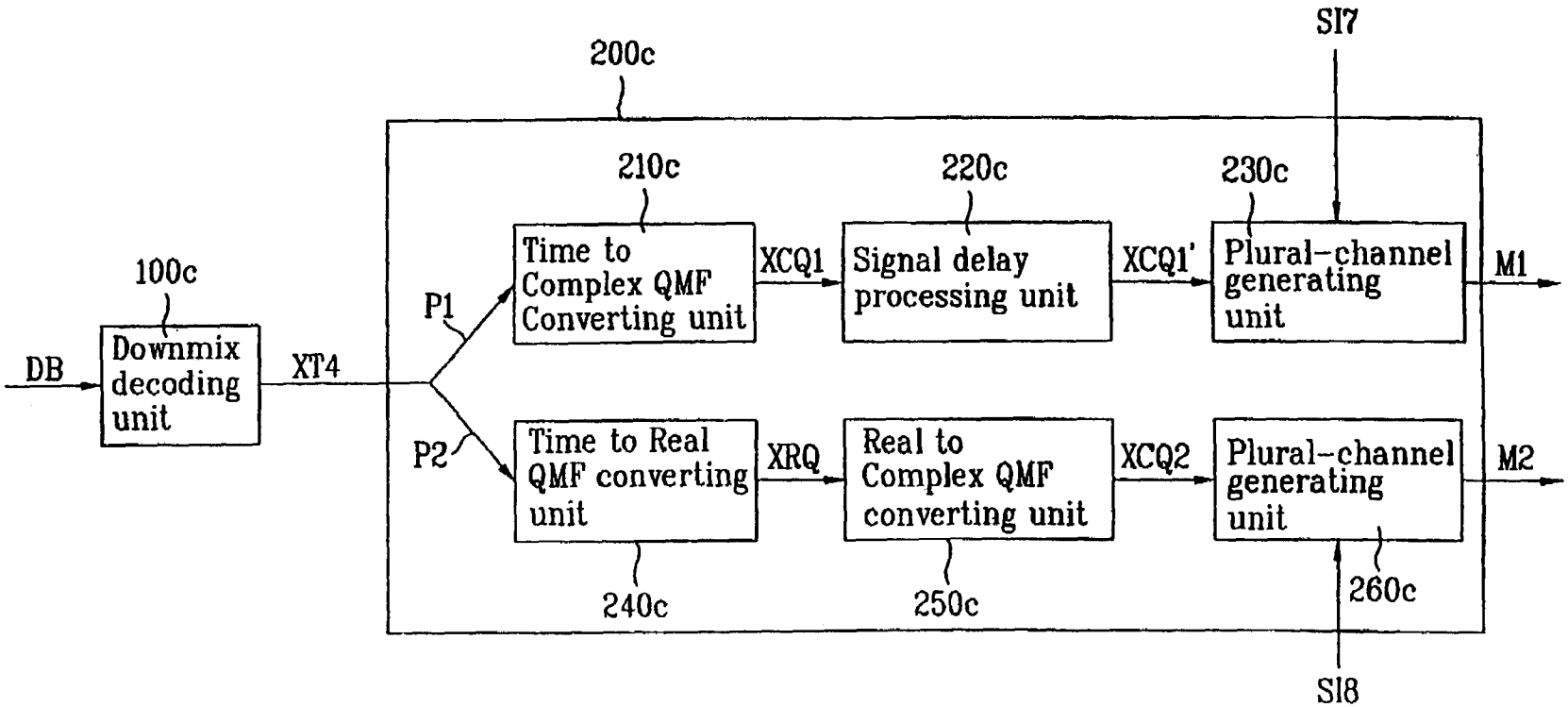
FIGS. 6 to 10 are block diagrams to explain a method of decoding an audio signal according to another embodiment of the present invention.

FIG. 6 is a block diagram to explain a method of decoding an audio signal according to another embodiment of the present invention.

Referring to FIG. 6, a decoding apparatus according to the present invention includes a downmix decoding unit 100*c* and a plural-channel decoding unit 200*c*.

In some embodiments, a downmix signal XT4 processed in the downmix decoding unit 100*c* is transmitted to the plural-channel decoding unit 200*c*, where the signal is combined with spatial information SI7 or SI8 to generate a plural-channel audio signal M1 or M2. In this case, the processed downmix signal XT4 is a downmix signal in a time domain.

An encoded downmix signal DB is transmitted to the downmix decoding unit 100*c* and processed. The processed downmix signal XT4 is transmitted to the plural-channel decoding unit 200*c*, which generates a plural-channel audio signal according to one of two kinds of decoding schemes: a high quality decoding scheme and a low power decoding scheme.

In case that the processed downmix signal XT4 is decoded by the low power decoding scheme, the downmix signal XT4 is transmitted and decoded along a path P2. The processed downmix signal XT4 is converted to a signal XRQ in a real QMF domain by a domain converting unit 240*c*.

The converted downmix signal XRQ is converted to a signal XQC2 in a complex QMF domain by a domain converting unit 250*c*. The XRQ downmix signal to the XQC2 downmix signal conversion is an example of complexity domain conversion.

Subsequently, the signal XQC2 in the complex QMF domain is combined with spatial information SI8 in a plural-channel generating unit 260*c* to generate the plural-channel audio signal M2.

Thus, in decoding the downmix signal XT4 by the low power decoding scheme, a separate delay processing procedure is not needed. This is because the time synchronization between the downmix signal and the spatial information is already matched according to the low power decoding scheme in audio signal encoding. That is, in this case, the downmix signal XRQ is not delayed by a decoding delay.

In case that the processed downmix signal XT4 is decoded by the high quality decoding scheme, the downmix signal XT4 is transmitted and decoded along a path P1. The processed downmix signal XT4 is converted to a signal XCQ1 in a complex QMF domain by a domain converting unit 210*c*.

The converted downmix signal XCQ1 is then delayed by a time delay difference between the downmix signal XCQ1 and spatial information SI7 in a signal delay processing unit 220*c*.

Subsequently, the delayed downmix signal XCQ1' is combined with spatial information SI7 in a plural-channel generating unit 230*c*, which generates the plural-channel audio signal M1.

Thus, the downmix signal XCQ1 passes through the signal delay processing unit 220*c*. This is because a time synchronization difference between the downmix signal XCQ1 and the spatial information SI7 is generated due to the encoding of the audio signal on the assumption that a low power decoding scheme will be used.

The time synchronization difference is a time delay difference, which depends on the decoding scheme that is used. For example, the time delay difference occurs because the decoding process of, for example, a low power decoding scheme is different than a decoding process of a high quality decoding scheme. The time delay difference is considered until a time point of combining a downmix signal and spatial information, since it may not be necessary to synchronize the downmix signal and spatial information after the time point of combining the downmix signal and the spatial information.

In FIG. 6, the time synchronization difference is a difference between a first delay time occurring until a time point of combining the downmix signal XCQ2 and the spatial information SI8 and a second delay time occurring until a time point of combining the downmix signal XCQ1' and the spatial information SI7. In this case, a time sample or timeslot can be used as a unit of time delay.

If the delay time occurring in the domain converting unit 210*c* is equal to the. delay time occurring in the domain converting unit 240*c*, it is enough for the signal delay processing unit 220*c* to delay the downmix signal XCQ1 by the delay time occurring in the domain converting unit 250*c*.

According to the embodiment shown in FIG. 6, the two decoding schemes are included in the plural-channel decoding unit 200*c*. Alternatively, one decoding scheme can be included in the plural-channel decoding unit 200*c*.

In the above-explained embodiment of the present invention, the time synchronization between the downmix signal and the spatial information is matched in accordance with the low power decoding scheme. Yet, the present invention further includes the case that the time synchronization between the downmix signal and the spatial information is matched in accordance with the high quality decoding scheme. In this case, the downmix signal is led in a manner opposite to the case of matching the time synchronization by the low power decoding scheme.

Figure 7:
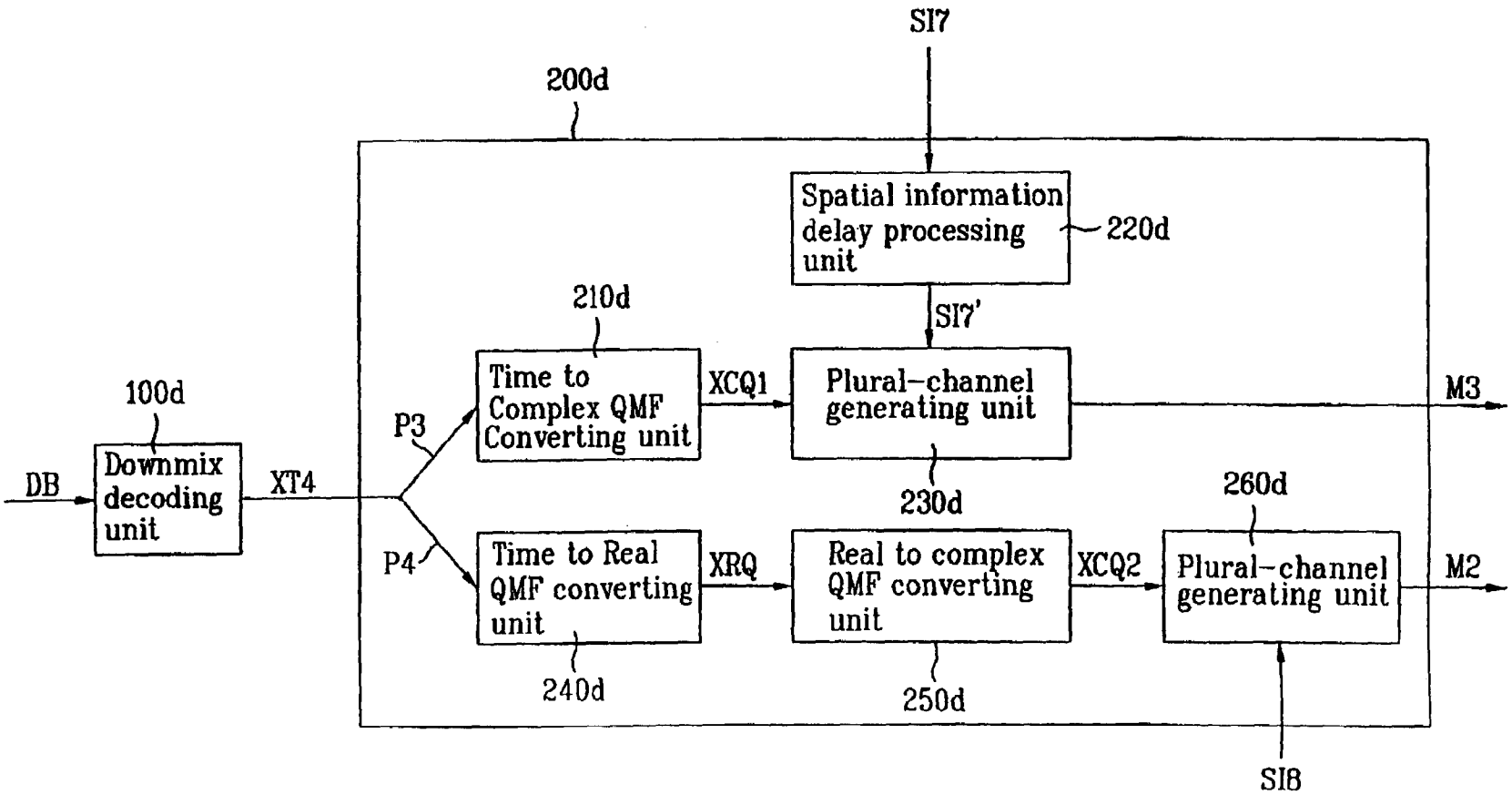

FIG. 7 is a block diagram to explain a method of decoding an audio signal according to another embodiment of the present invention.

Referring to FIG. 7, a decoding apparatus according to the present invention includes a downmix decoding unit 100*d* and a plural-channel decoding unit 200*d*.

A downmix signal XT4 processed in the downmix decoding unit 100*d* is transmitted to the plural-channel decoding unit 200*d*, where the downmix signal is combined with spatial information SI7' or SI8 to generate a plural-channel audio signal M3 or M2. In this case, the processed downmix signal XT4 is a signal in a time domain.

An encoded downmix signal DB is transmitted to the downmix decoding unit 100*d* and processed. The processed downmix signal XT4 is transmitted to the plural-channel decoding unit 200*d*, which generates a plural-channel audio signal according to one of two kinds of decoding schemes: a high quality decoding scheme and a low power decoding scheme.

In case that the processed downmix signal XT4 is decoded by the low power decoding scheme, the downmix signal XT4 is transmitted and decoded along a path P4. The processed downmix signal XT4 is converted to a signal XRQ in a real QMF domain by a domain converting unit 240*d*.

The converted downmix signal XRQ is converted to a signal XQC2 in a complex QMF domain by a domain converting unit 250*d*. The XRQ downmix signal to the XCQ2 downmix signal conversion is an example of complexity domain conversion.

Subsequently, the signal XQC2 in the complex QMF domain is combined with spatial information SI8 in a plural-channel generating unit 260*d* to generate the plural-channel audio signal M2.

Thus, in decoding the downmix signal XT4 by the low power decoding scheme, a separate delay processing procedure is not needed. This is because the time synchronization between the downmix signal and the spatial information is already matched according to the low power decoding scheme in audio signal encoding. That is, in this case, the spatial information SI8 is not delayed by a decoding delay.

In case that the processed downmix signal XT4 is decoded by the high quality decoding scheme, the downmix signal XT4 is transmitted and decoded along a path P3. The processed downmix signal XT4 is converted to a signal XCQ1 in a complex QMF domain by a domain converting unit 210*d*.

The converted downmix signal XCQ1 is transmitted to a plural-channel generating unit 230*d*, where it is combined with the spatial information SI7' to generate the plural-channel audio signal M3. In this case, the spatial information SI7' is the spatial information of which time delay is compensated for as the spatial information SI7 passes through a spatial information delay processing unit 220*d*.

Thus, the spatial information SI7 passes through the spatial information delay processing unit 220*d*. This is because a time synchronization difference between the downmix signal XCQ1 and the spatial information SI7 is generated due to the encoding of the audio signal on the assumption that a low power decoding scheme will be used.

The time synchronization difference is a time delay difference, which depends on the decoding scheme that is used. For example, the time delay difference occurs because the decoding process of, for example, a low power decoding scheme is different than a decoding process of a high quality decoding scheme. The time delay difference is considered until a time point of combining a downmix signal and spatial information, since it is not necessary to synchronize the downmix signal and spatial information after the time point of combining the downmix signal and the spatial information.

In FIG. 7, the time synchronization difference is a difference between a first delay time occurring until a time point of combining the downmix signal XCQ2 and the spatial information SI8 and a second delay time occurring until a time point of combining the downmix signal XCQ1 and the spatial information SI7'. In this case, a time sample or timeslot can be used as a unit of time delay.

If the delay time occurring in the domain converting unit 210*d* is equal to the delay time occurring in the domain converting unit 240*d*, it is enough for the spatial information delay processing unit 220*d* to lead the spatial information SI7 by the delay time occurring in the domain converting unit 250*d*.

In the example shown, the two decoding schemes are included in the plural-channel decoding unit 200*d*. Alternatively, one decoding scheme can be included in the plural-channel decoding unit 200*d*.

In the above-explained embodiment of the present invention, the time synchronization between the downmix signal and the spatial information is matched in accordance with the low power decoding scheme. Yet, the present invention further includes the case that the time synchronization between the downmix signal and the spatial information is matched in accordance with the high quality decoding scheme. In this case, the downmix signal is lagged in a manner opposite to the case of matching the time synchronization by the low power decoding scheme.

Although FIG. 6 and FIG. 7 exemplarily show that one of the signal delay processing unit 220*c* and the spatial information delay unit 220*d* is included in the plural-channel decoding unit 200*c* or 200*d*, the present invention includes an embodiment where the spatial information delay processing unit 220*d* and the signal delay processing unit 220*c* are included in the plural-channel decoding unit 200*c* or 200*d*. In this case, a total of a delay compensation time in the spatial information delay processing unit 220*d* and a delay compensation time in the signal delay processing unit 220*c* should be equal to the time synchronization difference.

Explained in the above description are the method of compensating for the time synchronization difference due to the existence of a plurality of the downmix input domains and the method of compensating for the time synchronization difference due to the presence of a plurality of the decoding schemes.

A method of compensating for a time synchronization difference due to the existence of a plurality of downmix input domains and the existence of a plurality of decoding schemes is explained as follows.

Figure 8:
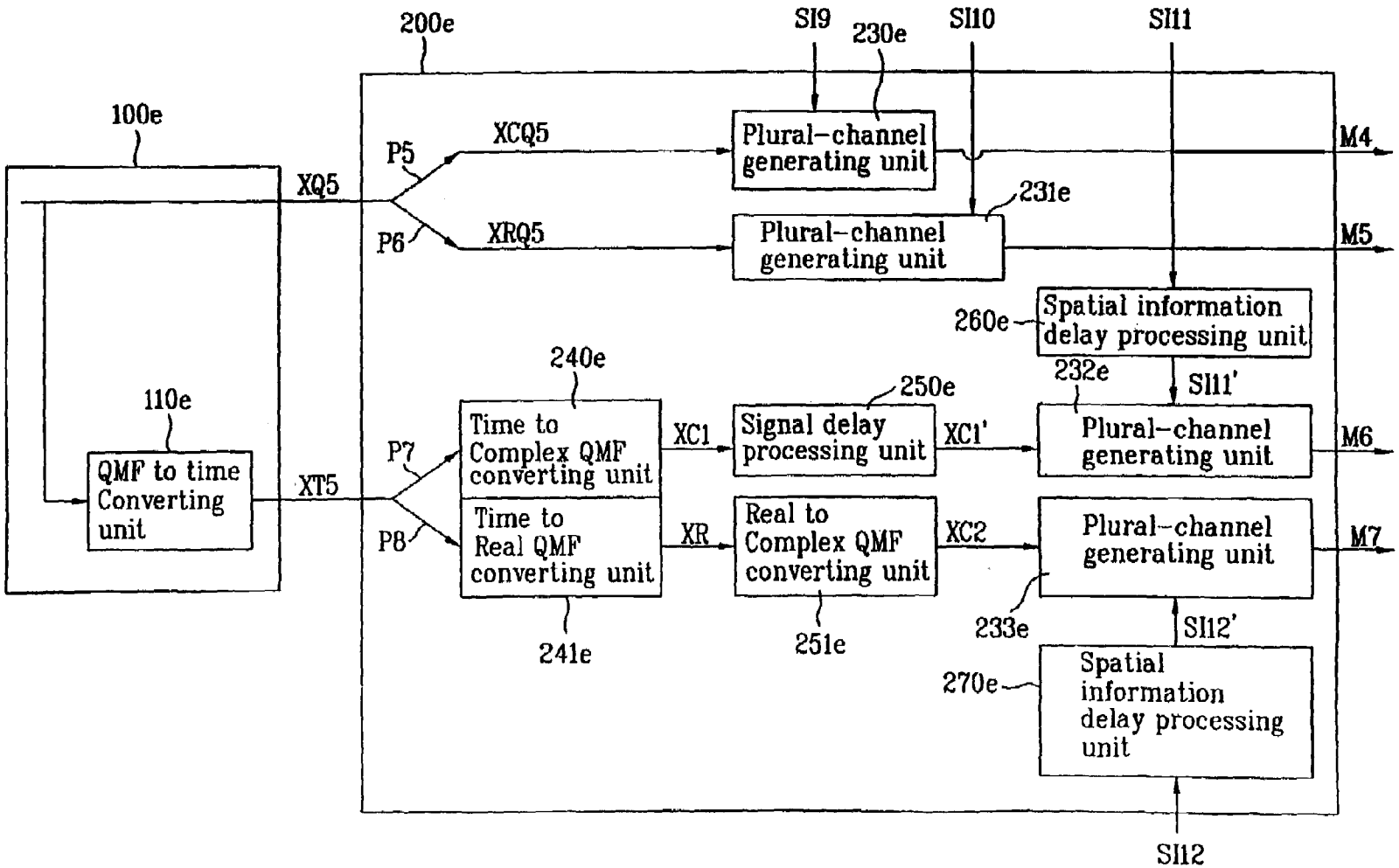

FIG. 8 is a block diagram to explain a method of decoding an audio signal according to one embodiment of the present invention.

Referring to FIG. 8, a decoding apparatus according to the present invention includes a downmix decoding unit 100*e* and a plural-channel decoding unit 200*e*.

In a method of processing an audio signal according to another embodiment of the present invention, a downmix signal processed in the downmix decoding unit 100*e* can be transmitted to the plural-channel decoding unit 200*e* in one of two kinds of domains. In the present embodiment, it is assumed that time synchronization between a downmix signal and spatial information is matched on a QMF domain with reference to a low power decoding scheme. Alternatively, various modifications can be applied to the present invention.

A method that a downmix signal XQ5 processed in a QMF domain is processed by being transmitted to the plural-channel decoding unit 200*e* is explained as follows. In this case, the downmix signal XQ5 can be any one of a complex QMF signal XCQ5 and real QMF single XRQ5. The XCQ5 is processed by the high quality decoding scheme in the downmix decoding unit 100*e*. The XRQ5 is processed by the low power decoding scheme in the downmix decoding unit 100*e*.

In the present embodiment, it is assumed that a signal processed by a high quality decoding scheme in the downmix decoding unit 100*e* is connected to the plural-channel decoding unit 200*e* of the high quality decoding scheme, and a signal processed by the low power decoding scheme in the downmix decoding unit 100*e* is connected to the plural-channel decoding unit 200*e* of the low power decoding scheme. Alternatively, various modifications can be applied to the present invention.

In case that the processed downmix signal XQ5 is decoded by the low power decoding scheme, the downmix signal XQ5 is transmitted and decoded along a path P6. In this case, the XQ5 is a downmix signal XRQ5 in a real QMF domain.

The downmix signal XRQ5 is combined with spatial information SI10 in a multi-channel generating unit 231*e* to generate a multi-channel audio signal M5.

Thus, in decoding the downmix signal XQ5 by the low power decoding scheme, a separate delay processing procedure is not needed. This is because the time synchronization between the downmix signal and the spatial information is already matched according to the low power decoding scheme in audio signal encoding.

In case that the processed downmix signal XQ5 is decoded by the high quality decoding scheme, the downmix signal XQ5 is transmitted and decoded along a path P5. In this case, the XQ5 is a downmix signal XCQ5 in a complex QMF domain. The downmix signal XCQ5 is combined with the spatial information S19 in a multi-channel generating unit 230*e* to generate a multi-channel audio signal M4.

Explained in the following is a case that a downmix signal XT5 processed in a time domain is transmitted to the plural-channel decoding unit 200*e* for signal processing.

A downmix signal XT5 processed in the downmix decoding unit 100*e* is transmitted to the plural-channel decoding unit 200*e*, where it is combined with spatial information SI11 or SI12 to generate a plural-channel audio signal M6 or M7.

The downmix signal XT5 is transmitted to the plural-channel decoding unit 200*e*, which generates a plural-channel audio signal according to one of two kinds of decoding schemes: a high quality decoding scheme and a low power decoding scheme.

In case that the processed downmix signal XT5 is decoded by the low power decoding scheme, the downmix signal XT5 is transmitted and decoded along a path P8. The processed downmix signal XT5 is converted to a signal XR in a real QMF domain by a domain converting unit 241*e*.

The converted downmix signal XR is converted to a signal XC2 in a complex QMF domain by a domain converting unit 250*e*. The XR downmix signal to the XC2 downmix signal conversion is an example of complexity domain conversion.

Subsequently, the signal XC2 in the complex QMF domain is combined with spatial information SI12' in a plural-channel generating unit 233*e*, which generates a plural-channel audio signal M7.

In this case, the spatial information SI12' is the spatial information of which time delay is compensated for as the spatial information SI12 passes through a spatial information delay processing unit 240*e*.

Thus, the spatial information SI12 passes through the spatial information delay processing unit 240*e*. This is because a time synchronization difference between the downmix signal XC2 and the spatial information SI12 is generated due to the audio signal encoding performed by the low power decoding scheme on the assumption that a domain, of which time synchronization between the downmix signal and the spatial information is matched, is the QMF domain. There the delayed spatial information SI12' is delayed by the encoding delay and the decoding delay.

In case that the processed downmix signal XT5 is decoded by the high quality decoding scheme, the downmix signal XT5 is transmitted and decoded along a path P7. The processed downmix signal XT5 is converted to a signal XC1 in a complex QMF domain by a domain converting unit 240*e*.

The converted downmix signal XC1 and the spatial information SI11 are compensated for a time delay by a time synchronization difference between the downmix signal XC1 and the spatial information SI11 in a signal delay processing unit 250*e* and a spatial information delay processing unit 260*e*, respectively.

Subsequently, the time-delay-compensated downmix signal XC1' is combined with the time-delay-compensated spatial information SI11' in a plural-channel generating unit 232*e*, which generates a plural-channel audio signal M6.

Thus, the downmix signal XC1 passes through the signal delay processing unit 250*e* and the spatial information SI11 passes through the spatial information delay processing unit 260*e*. This is because a time synchronization difference between the downmix signal XC1 and the spatial information SI11 is generated due to the encoding of the audio signal under the assumption of a low power decoding scheme, and on the further assumption that a domain, of which time synchronization between the downmix signal and the spatial information is matched, is the QMF domain.

Figure 9:
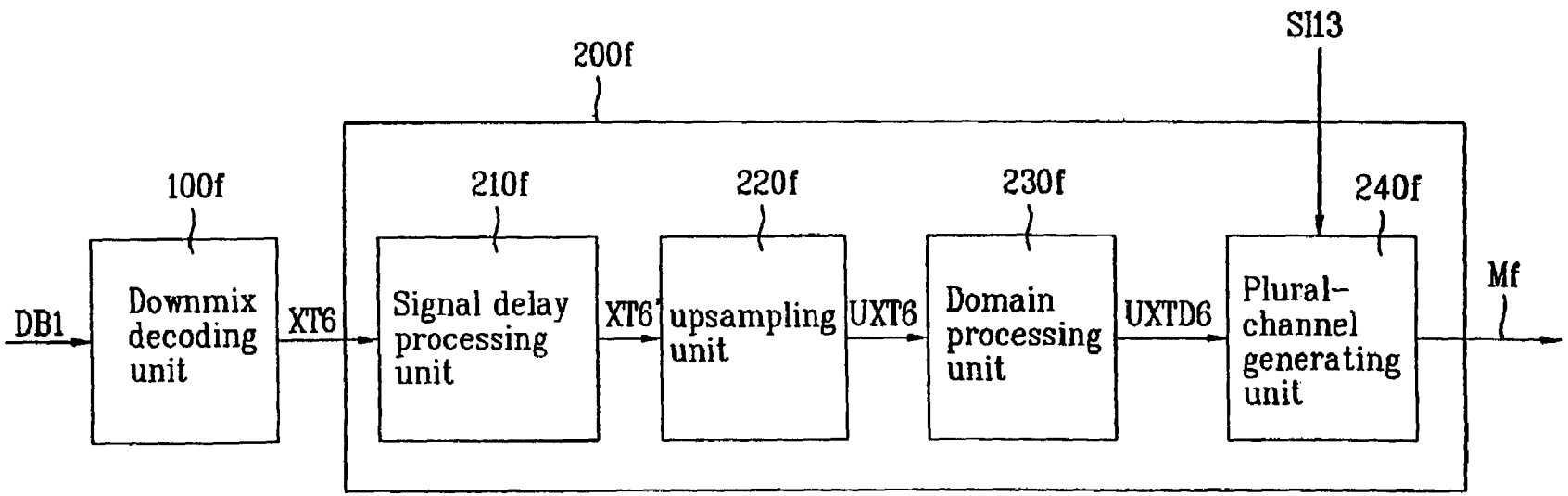

FIG. 9 is a block diagram to explain a method of decoding an audio signal according to one embodiment of the present invention.

Referring to FIG. 9, a decoding apparatus according to the present invention includes a downmix decoding unit 100*f* and a plural-channel decoding unit 200*f*.

An encoded downmix signal DB1 is transmitted to the downmix decoding unit 100*f* and then processed. The downmix signal DB1 is encoded considering two downmix decoding schemes, including a first downmix decoding and a second downmix decoding scheme.

The downmix signal DB1 is processed according to one downmix decoding scheme in downmix decoding unit 100*f*. The one downmix decoding scheme can be the first downmix decoding scheme.

The processed downmix signal XT6 is transmitted to the plural-channel decoding unit 200*f*, which generates a plural-channel audio signal Mf.

The processed downmix signal XT6' is delayed by a decoding delay in a signal processing unit 210*f*. The downmix signal XT6' can be a delayed by a decoding delay. The reason why the downmix signal XT6 is delayed is that the downmix decoding scheme that is accounted for in encoding is different from the downmix decoding scheme used in decoding.

Therefore, it can be necessary to upsample the downmix signal XT6' according to the circumstances.

The delayed downmix signal XT6' is upsampled in upsampling unit 220*f*. The reason why the downmix signal XT6' is upsampled is that the number of samples of the downmix signal XT6' is different from the number of samples of the spatial information SI13.

The order of the delay processing of the downmix signal XT6 and the upsampling processing of the downmix signal XT6' is interchangeable.

The domain of the upsampled downmix signal UXT6 is converted in domain processing unit 230*f*. The conversion of the domain of the downmix signal UXT6 can include the F/T domain conversion and the complexity domain conversion.

Subsequently, the domain converted downmix signal UXTD6 is combined with spatial information SI13 in a plural-channel generating unit 260*d*, which generates the plural-channel audio signal Mf.

Explained in the above description is the method of compensating for the time synchronization difference generated between the downmix signal and the spatial information.

Explained in the following description is a method of compensating for a time synchronization difference generated between time series data and a plural-channel audio signal generated by one of the aforesaid methods.

Figure 10:
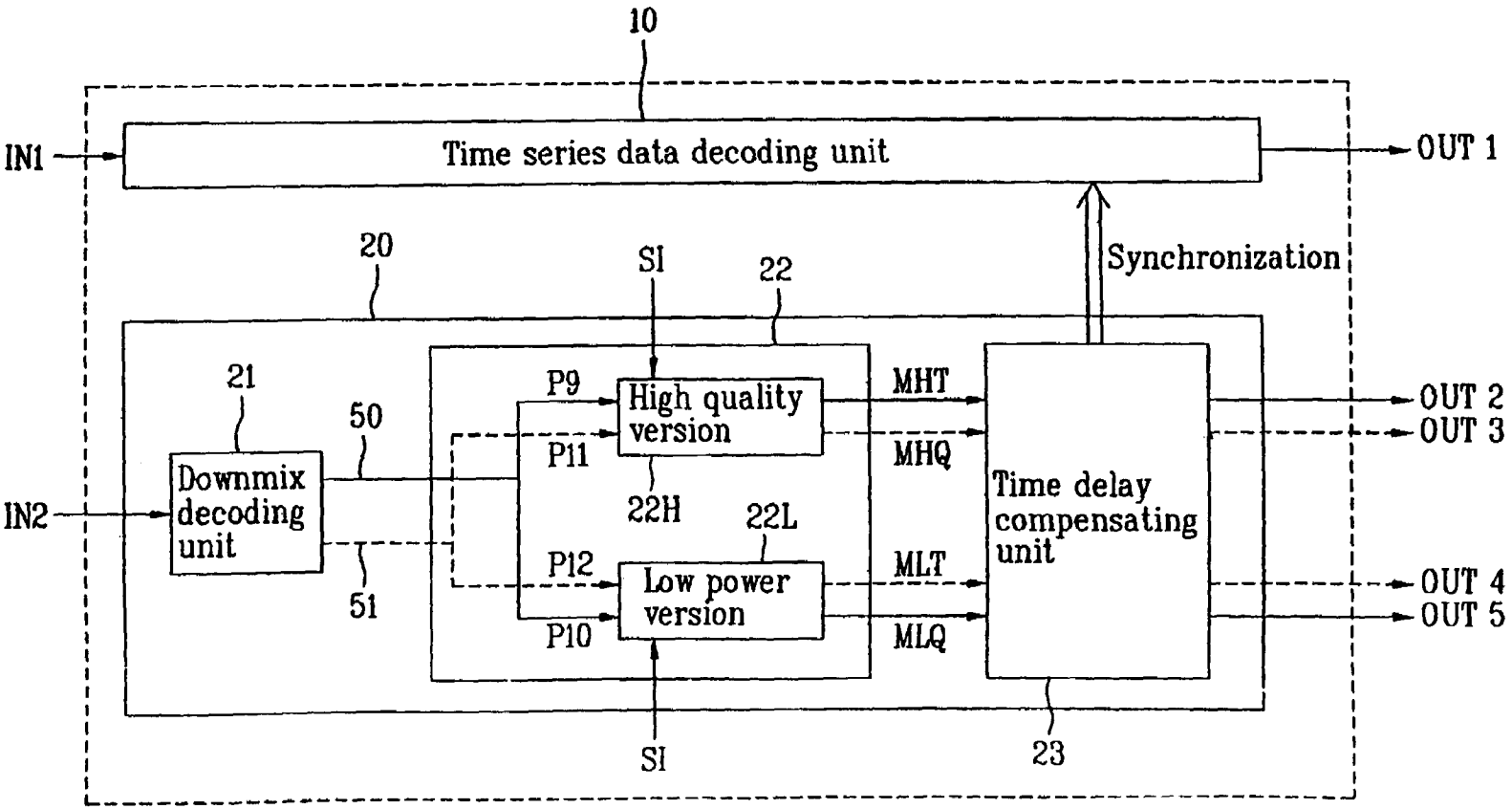

FIG. 10 is a block diagram of an apparatus for decoding an audio signal according to one embodiment of the present invention.

Referring to FIG. 10, an apparatus for decoding an audio signal according to one embodiment of the present invention includes a time series data decoding unit 10 and a plural-channel audio signal processing unit 20.

The plural-channel audio signal processing unit 20 includes a downmix decoding unit 21, a plural-channel decoding unit 22 and a time delay compensating unit 23.

A downmix bitstream IN2, which is an example of an encoded downmix signal, is inputted to the downmix decoding unit 21 to be decoded.

In this case, the downmix bit stream IN2 can be decoded and outputted in two kinds of domains. The output available domains include a time domain and a QMF domain. A reference number '50' indicates a downmix signal decoded and outputted in a time domain and a reference number '51' indicates a downmix signal decoded and outputted in a QMF domain. In the present embodiment, two kinds of domains are described. The present invention, however, includes downmix signals decoded and outputted on other kinds of domains.

The downmix signals 50 and 51 are transmitted to the plural-channel decoding unit 22 and then decoded according to two kinds of decoding schemes 22H and 22L, respectively. In this case, the reference number '22H' indicates a high quality decoding scheme and the reference number '22L' indicates a low power decoding scheme.

In this embodiment of the present invention, only two kinds of decoding schemes are employed. The present invention, however, is able to employ more decoding schemes.

The downmix signal 50 decoded and outputted in the time domain is decoded according to a selection of one of two paths P9 and P10. In this case, the path P9 indicates a path for decoding by the high quality decoding scheme 22H and the path P10 indicates a path for decoding by the low power decoding scheme 22L.

The downmix signal 50 transmitted along the path P9 is combined with spatial information SI according to the high quality decoding scheme 22H to generate a plural-channel audio signal MHT. The downmix signal 50 transmitted along the path P10 is combined with spatial information SI according to the low power decoding scheme 22L to generate a plural-channel audio signal MLT.

The other downmix signal 51 decoded and outputted in the QMF domain is decoded according to a selection of one of two paths P11 and P12. In this case, the path P11 indicates a path for decoding by the high quality decoding scheme 22H and the path P12 indicates a path for decoding by the low power decoding scheme 22L.

The downmix signal 51 transmitted along the path P11 is combined with spatial information SI according to the high quality decoding scheme 22H to generate a plural-channel audio signal MHQ. The downmix signal 51 transmitted along the path P12 is combined with spatial information SI according to the low power decoding scheme 22L to generate a plural-channel audio signal MLQ.

At least one of the plural-channel audio signals MHT, MHQ, MLT and MLQ generated by the above-explained methods undergoes a time delay compensating process in the time delay compensating unit 23 and is then outputted as OUT2, OUT3, OUT4 or OUT5.

In the present embodiment, the time delay compensating process is able to prevent a time delay from occurring in a manner of comparing a time synchronization mismatched plural-channel audio signal MHQ, MLT or MKQ to a plural-channel audio signal MHT on the assumption that a time synchronization between time-series data OUT1 decoded and outputted in the time series decoding unit 10 and the aforesaid plural-channel audio signal MHT is matched. Of course, if a time synchronization between the time series data OUT1 and one of the plural-channel audio signals MHQ, MLT and MLQ except the aforesaid plural-channel audio signal MHT is matched, a time synchronization with the time series data OUT1 can be matched by compensating for a time delay of one of the rest of the plural-channel audio signals of which time synchronization is mismatched.

The embodiment can also perform the time delay compensating process in case that the time series data OUT1 and the plural-channel audio signal MHT, MHQ, MLT or MLQ are not processed together. For instance, a time delay of the plural-channel audio signal is compensated and is prevented from occurring using a result of comparison with the plural-channel audio signal MLT. This can be diversified in various ways.

Accordingly, the present invention provides the following effects or advantages.

First, if a time synchronization difference between a downmix signal and spatial information is generated, the present invention prevents audio quality degradation by compensating for the time synchronization difference.

Second, the present invention is able to compensate for a time synchronization difference between time series data and a plural-channel audio signal to be processed together with the time series data of a moving picture, a text, a still image and the like.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A method of decoding an audio signal performed by an audio decoding apparatus, comprising:

receiving, in the audio decoding apparatus, an audio signal including a downmix signal of a time domain and spatial information, the spatial information being delayed within the audio signal according to a first scheme;

domain converting, in the audio decoding apparatus, the downmix signal of the time domain according to a second scheme;

delaying, in the audio decoding apparatus, the domain-converted downmix signal by an amount of time substantially equal to a difference between an amount of delay of the spatial information within the audio signal and an elapsed time during the domain converting of the downmix signal; and combining, in the audio decoding apparatus, the delayed downmix signal with the spatial information.

2. The method of claim 1, wherein the spatial information is not delayed by the audio decoding apparatus.

3. The method of claim 1, wherein the first scheme includes converting the downmix signal of the time domain to a real quadrature mirror filter (QMF) domain and converting the downmix signal of the real OMF domain to a complex QMF domain, and wherein the second scheme includes directly converting the downmix signal of the time domain to a complex QMF domain.

4. The method of claim 3, wherein the amount of time is approximately equal to an elapsed time during the converting the downmix signal of the real QMF domain to the complex QMF domain.

5. The method of claim 1, wherein the first scheme is for reducing power loss and wherein the second scheme is for improving sound quality.

6. An apparatus for decoding an audio signal, comprising:

an audio signal receiving unit receiving an audio signal including a downmix signal of a time domain and spatial information, the spatial information being delayed within the audio signal according to a first scheme;

a processor of a domain converting unit converting the downmix signal of the time domain according to a second scheme;

a delaying unit delaying the domain-converted downmix signal by an amount of time substantially equal to a difference between an amount of delay of the spatial information within the audio signal and an elapsed time during the domain converting of the downmix signal; and a processor of a spatial information combining unit combining the delayed downmix signal with the spatial information.

7. The apparatus of claim 6, wherein the spatial information is not delayed in the apparatus.

8. The apparatus of claim 6, wherein the first scheme includes converting the downmix signal of the time domain to a real quadrature mirror filter (QMF) domain and converting the downmix signal of the real QMF domain to a complex QMF domain, and wherein the second scheme includes directly converting the downmix signal of the time domain to a complex QMF domain.

9. The apparatus of claim 6, wherein the amount of time is approximately equal to an elapsed time during the converting the downmix signal of the real QMF domain to the complex QMF domain.

10. The apparatus of claim 6, wherein the first scheme is for reducing power loss and wherein the second scheme is for improving sound quality.

11. A computer-readable medium selected from the group consisting of a non-volatile medium, a volatile medium, and combinations thereof the computer-readable medium having instructions stored thereon, which, when executed by a processor, cause the processor to perform:

receiving an audio signal including a downmix signal of a time domain and spatial information, the spatial information being delayed within the audio signal according to a first scheme;

domain converting the downmix signal of the time domain according to a second scheme;

delaying the domain-converted downmix signal by an amount of time substantially equal to a difference between an amount of delay of the spatial information within the audio signal and an elapsed time during the domain converting of the downmix signal; and combining the delayed downmix signal with the spatial information.

12. The computer-readable medium of claim 11, wherein the first scheme includes converting the downmix signal of the time domain to a real quadrature mirror filter (QMB) domain and converting the downmix signal of the real QMF domain to a complex QMF domain, and wherein the second scheme includes directly converting the downmix signal of the time domain to a complex QMF domain.

13. The computer-readable medium of claim 12, wherein the amount of time is approximately equal to an elapsed time during the converting the downmix signal of the real QMF domain to the complex QMF domain.

14. The computer-readable medium of claim 12, wherein the first scheme is for reducing power loss and wherein the second scheme is for improving sound quality.

15. The computer-readable medium of claim 12, wherein the domain-converted downmix signal is delayed in delay unit of a decoding apparatus, and wherein the spatial information is not delayed by the decoding apparatus.

* * * * *

UNITED STATES PATENT AND TRADEMARK OFFICE

CERTIFICATE OF CORRECTION

PATENT NO. : 7,653,533 B2
APPLICATION NO. : 11/540920
DATED : January 26, 2010
INVENTOR(S) : Pang et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 670 days.

Signed and Sealed this

Twenty-eighth Day of December, 2010

David J. Kappos

David J. Kappos
*Director of the United States Patent and Trademark Office*